US005302087A

United States Patent [19]

Pacht

[11] Patent Number: 5,302,087

[45] Date of Patent: Apr. 12, 1994

[54] HIGH PRESSURE PUMP WITH LOADED COMPRESSION RODS AND METHOD

[75] Inventor: Amos Pacht, Houston, Tex.

[73] Assignee: Butterworth Jetting Systems, Inc., Houston, Tex.

[21] Appl. No.: 54,728

[22] Filed: Apr. 29, 1993

[51] Int. Cl.[5] ..... F04B 21/02

[52] U.S. Cl. ..... 417/53; 417/539; 417/571; 92/80

[58] Field of Search ..... 417/53, 539, 571; 92/80

[56] References Cited

U.S. PATENT DOCUMENTS

| | | | |
|---|---|---|---|
| 3,309,013 | 3/1967 | Bauer | 417/571 X |
| 3,370,545 | 2/1968 | Waibel | 417/571 |
| 4,432,386 | 2/1984 | Pacht . | |
| 4,551,077 | 11/1985 | Pacht . | |
| 4,593,858 | 6/1986 | Pacht . | |
| 4,878,815 | 11/1989 | Stachowiak | 417/571 X |
| 5,127,807 | 7/1992 | Eslinger | 417/539 X |
| 5,171,136 | 12/1992 | Pacht . | |

*Primary Examiner*—Richard E. Gluck
*Attorney, Agent, or Firm*—Browning, Bushman, Anderson & Brookhart

[57] ABSTRACT

A high pressure pump includes a housing having a pump chamber therein for receiving a pump piston, and a separate pressure housing having a liquid pressure chamber therein in fluid communication with a pump discharge flow line within an outlet housing. A force-transmitting piston is provided within the pressure housing and is movable along an axis substantially coincident with the central axis of the pump piston to place a desired load on each of a plurality of compression rods. The pump may be initially manufactured with the pressure housing, or a separate pressure housing may be added to an existing pump without modifying other pump components. According to the method of this invention, a control valve in a compression line is opened, the pump is activated, then the compression line is closed to maintain the compression rods under load.

29 Claims, 2 Drawing Sheets

HIGH PRESSURE PUMP WITH LOADED COMPRESSION RODS AND METHOD

FIELD OF THE INVENTION

The present invention relates to improved methods and apparatus for constructing and operating a high pressure pump. More particularly, the present invention relates to improvements involved in placing a desired axial load upon each of a plurality of compression rods spaced outwardly of the pump chamber for sealingly mating a pump housing and an outlet housing.

BACKGROUND OF THE INVENTION

People familiar with the benefits of high pressure fluid systems having long desired higher pressure pumps which are cost effective to power such systems. In the cleaning industry, for example, fluid gun operators have recognized for years the enhanced benefits of cleaning with fluid pressure in excess of 12,000 PSI. Systems capable of operating at 20,000 PSI or even 40,000 PSI are being seriously considered for cleaning applications, and those skilled in the hydroblasting art appreciate the substantially enhanced capability of such higher pressure systems.

A significant problem with obtaining such higher fluid pressures on a commercial basis relates to the cost and life of the fluid pump. Pumps with a plurality of plungers are commonly used for obtaining high pressures, and such high pressure pumps preferably utilize an inline valve pump design, as disclosed in U.S. Pat. No. 4,551,077, for generating high fluid pressure without causing significant metal fatigue which leads to pump failure. As the maximum output pressure from the inline pump increases, increased difficulties are encountered in the operation of placing the pump compression rods under the desired axial load. A plurality of these rods (typically four) are conventionally provided exterior of the pump chamber, and provide the desired compressive force to reliably seal the pump housing to the outlet housing. The rods are typically threaded for receiving corresponding nuts, and large powered wrenches have been employed to torque such nuts to the extent desired to produce a high compressive force. This desired compressive force maintains sealing between the pump housing and the outlet housing, which may comprise a pump discharge housing and a suction valve seat member. Powered wrenches, in turn, have their own capacity limitations, and are a significant drawback to the low cost maintenance and repair of a pump, since pump operators frequently do not have the necessary wrenches to torque the nuts to the extent recommended by the pump manufacturer. Hydraulic nuts have been proposed to place threaded rods under a significant load to produce a necessary compressive force, but these hydraulic nuts are expensive, and their utilization requires a fluid power source that may not be available.

As a consequence, some high pressure pumps fail because of leakage between the pump housing and the pump outlet housing, wherein the leakage is attributable to the failure to provide the necessary torque on one or more of the nuts that cooperate with the plurality of pump compression rods. To overcome this problem, some maintenance personnel have utilized larger and more expensive wrenches to torque the nuts, and in some instances have applied substantially more torque to the nuts than recommended by the pump manufacturer. In these cases, the compression rods are subjected to a substantially higher axial load than desired, which contributes to fatigue and failure of pump components. Due to the substantial forces involved, failure of a compression rod may cause significant damages to the pump and adjacent equipment, and more importantly may cause injury or death to personnel.

Improved methods and apparatus are required to facilitate the manufacture and repair of a high pressure pump in a manner that will subject pump compression rods to the necessary load required to seal the pump housing with the outlet housing, but will not overload these compression rods and thereby decrease the life of the pump. Pump life can be substantially enhanced according to the techniques of the present invention, while repair and maintenance costs for a pump are reduced since both the time and the equipment required to disassemble and reassemble a high pressure pump are significantly reduced.

The disadvantages of the prior art are overcome by the present invention, and an improved pump and a method of axially loading pump compression rods are hereinafter disclosed that will significantly contribute to the desire for a relatively low cost, high pressure pump.

SUMMARY OF THE INVENTION

In one embodiment, the pump according to the present invention comprises a pump housing having a pump chamber therein for receiving a pump piston that is movable along a central axis during stroking of the pump, a suction valve seat member including a fluid inlet and a plurality of fluid passageways for fluid communication between the fluid inlet and the pump chamber, and a pump discharge housing having a pump discharge flow line therein for receiving high pressure fluid from the pump chamber. The pump discharge valve passes fluid downstream from the pump chamber to the discharge flow line, and prevents high pressure fluid within the discharge flow line from returning to the pump chamber. A plurality of compression members, such as threaded rods, are spaced outwardly from the pump chamber, and provide the force necessary to seal the suction valve seal member between the pump housing and the pump discharge housing with static seals.

A pressure housing is integrally formed with the pump discharge housing, and has a liquid pressure chamber therein in fluid communication with the pump discharge flow line via a compression line. A force-transmitting piston within the pressure housing seals high pressure fluid within the liquid pressure chamber, while transmitting force to a force-receiving housing spaced opposite the pump housing with respect to the pump discharge housing. A control valve spaced along the compression line may be opened for receiving high pressure fluid within the liquid pressure chamber from the pump chamber, then closed to trap the high pressure fluid within the liquid pressure chamber to maintain the desired axial load upon the plurality of compression rods.

The pump according to the present invention preferably is of the inline design, wherein each of an inlet valve that passes fluid to the pump chamber and a discharge valve that prevents high pressure downstream fluid from returning to the pump chamber are movable along an axis substantially coincident with a central axis of the pump piston. The force-transmitting piston within the pressure housing has a dynamic cross-sectional sealing area that is desirably slightly greater than the cross-section sealing area of the larger of the static seals between the suction valve seat member and both the pump housing and the pump discharge housing, so that the axial force generated by the force-transmitting piston is always greater than the force required to maintain sealing engagement between the suction valve seat member and both the pump housing and the pump discharge housing.

The concept of the present invention is particularly well suited for a pump having a plurality of pump chambers and corresponding plurality of pump pistons each movable along a respective one of a plurality of central axes during stroking of the pump. For this embodiment, the pressure housing includes a corresponding plurality of liquid pressure chambers and a corresponding plurality of force-transmitting pistons therein each in fluid communication with the pump discharge flow line. The control valve spaced along the compression line preferably includes a valve body structurally separate from the pump discharge housing, so that the entirety of this control valve may be replaced without modifying the pressure housing or the pump discharge housing.

According to the method of the present invention, a movable sealing member is provided within the liquid pressure chamber for sealing high pressure fluid within the liquid pressure chamber while transmitting force to the force-receiving housing. The pump is activated to generate a desired a high pressure within the pump discharge flow line, then the compression line is opened to create a desired load on each of the plurality of compression rods. The compression flow line thereafter is closed to seal the high pressure fluid within the liquid pressure chamber while maintaining the high load on each of the plurality of compression rods. This technique ensures that each of the compression rods is subject to a substantially constant load, thereby minimizing fatigue that would inherently occur if the compression rods were intermittently subjected to a high pressure load. Accordingly to the method of the present invention, the cross-sectional sealing area for the force-transmitting piston preferably is above 25% greater than the cross-sectional sealing area between the pump housing and the suction valve seat member. The control valve is closed when the pump is actuated to generate a desired high pressure substantially equal to the maximum high pressure envisioned during operation of the pump, so that the force-transmitting rods are subjected to a substantially constant load that reliably seals the pump housing and the outlet housing.

It is an object of the present invention to provide an improved high pressure pump that utilizes pump pressure to subject a plurality of pump compression members to a load sufficient to reliably seal the pump housing and the outlet housing.

It is a further object of the this invention to provide the pump that utilizes improved techniques to subject the plurality of compression rods to a selected load without requiring special tooling, and whereby the pump compression rods are neither overloaded nor under-loaded to accomplish their desired purpose of sealing the pump housing and the outlet housing in a reliable manner that minimizes failure of pump compression rods.

It is a feature of this invention that a high pressure pump includes a force-transmitting piston within a pressure housing that is movable along an axis substantially coincident with the central axis of the pump piston, so that a uniform load may be applied to each of the plurality of compression members.

Yet another feature of the invention is that the force-transmitting piston has a dynamic cross-sectional sealing area slightly greater than the cross-sectional sealing area of the static seal between the pump housing and the outlet housing, so that reliable static sealing between these housings is continually maintained.

Still another feature of this invention is that improved techniques are provided for applying a desired load on the pump compression members of a high pressure pump having an inline pump design.

A significant advantage of the present invention is that the pump discharge housing and the pressure housing may be formed as an integral housing during initial manufacture of the pump, although the pressure housing may be separate from the pump discharge housing when modifying an existing pump to include the features of the present invention without altering the pump discharge housing.

Yet another advantage of this invention is that conventional threaded rods and corresponding mated nuts may be reliably used to provide the desired compressive force to seal between the pump housing and the outlet housing.

Still another advantage of the present invention is that pump manufacturing costs are not significantly increased, although high pump pressures are reliably and inexpensively maintained, and the pump according to the present invention may be easily and inexpensively disassembled, repaired, and reassembled.

These and further objects, features, and advantages of the present invention will become apparent from the following detailed description, wherein reference is made to the Figures in the accompanying drawings.

DETAILED DESCRIPTION OF PREFERRED EMBODIMENTS

Figure 1:
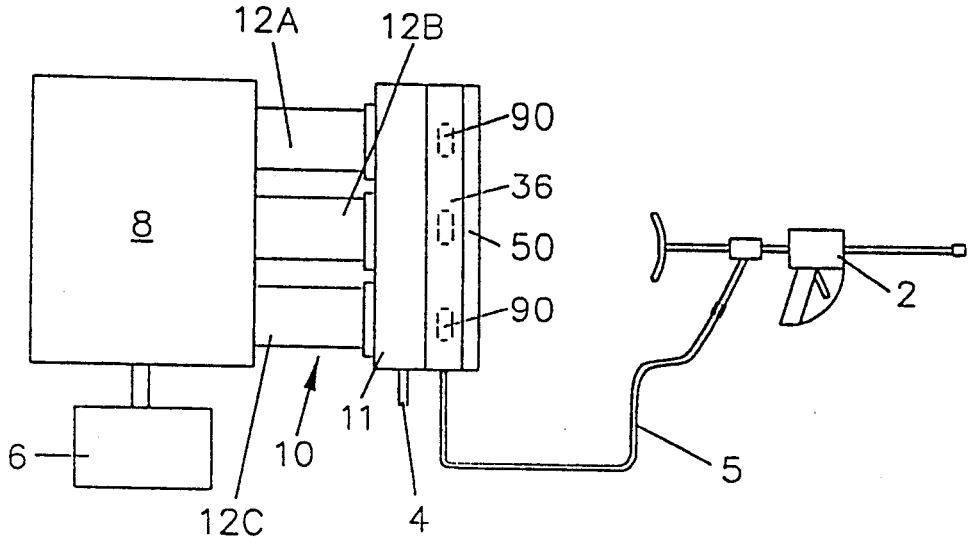
FIG. 1 is a diagrammatic drawing of a high pressure water jetting system utilizing a pump of the present invention.

FIG. 1 generally depicts a pump 10 manufactured according to the present invention. With the exception of the pressure housing, the force-receiving housing, and a control valve each discussed subsequently, the pump of this invention may be similar to other high pressure inline pumps, and accordingly will only be briefly described below. Those skilled in the art will appreciate that pump 10 may have either a single or a plurality of plungers or pump pistons each of which are reciprocated by a drive housing 8 connected to a suitable motor or engine 6. More particularly, the pump 10 is of the triplex variety having three spaced plungers each driven by the drive housing 8, and accordingly pump chamber housings 12A, 12B and 12C are generally depicted in FIG. 1. The pump 10 includes an inlet or suction manifold 34, a pump discharge manifold 36, and a pressure receiving plate or housing 50 described subsequently. A pump inlet line 4 supplies water to manifold 34, and the discharge from the pump 10 is passed through a high pressure hose 5 to power a water jetting or hydroblasting gun 2 used in a high pressure cleaning operation.

Figure 2:
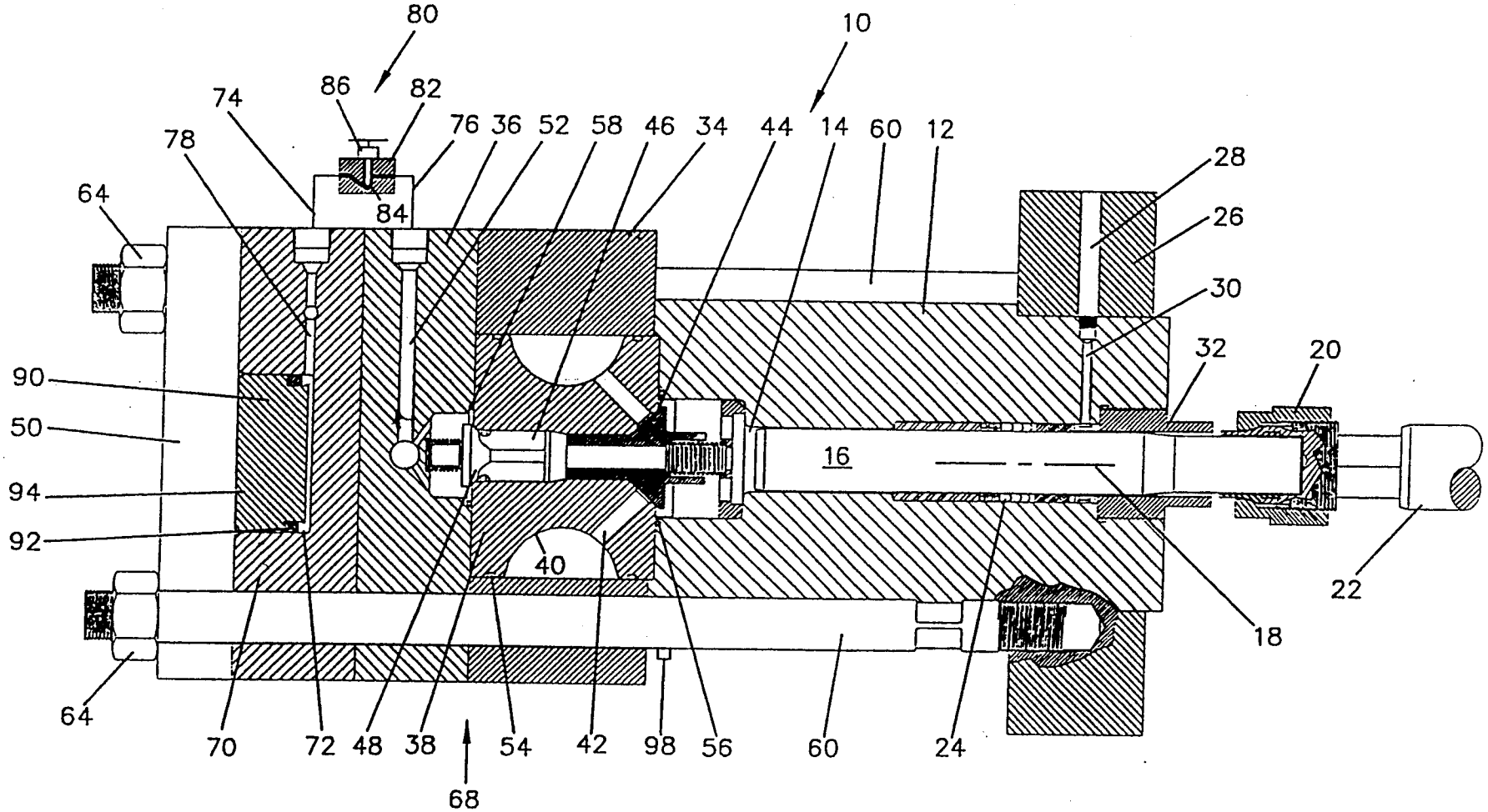
FIG. 2 is a simplified side view, partially in cross-section, of one embodiment of an inline fluid pump according to the present invention.

Referring now to FIG. 2, pump 10 comprises a pump cylinder housing 12 defining a cylindrical pump chamber 14 therein. Those skilled in the art will appreciate that pump cylinder housing or pump housing 12 as shown in FIG. 2 may be any one of the housings 12A, 12B or 12C generally depicted in FIG. 1. Plunger or pump piston 16 is linearly moveable within the pump chamber 14 along central pump axis 18 during stroking of the pump, and a suitable coupling 20 is depicted for interconnecting the pump piston 16 and drive housing output rod 22. A pump sealing assembly 24 maintains a fluid tight seal between the pump piston 16 and the pump cylinder housing 12. A gland nut 32 maintains the sealing assembly in place, but may be unthreaded to repair or replace the sealing assembly 24. Packing ring housing 26 includes a flow path 28 therein aligned with path 30 in the pump cylinder housing 12 to energize the sealing assembly 24.

Inlet line 4 (see FIG. 1) is connected to suction manifold 34 spaced between pump cylinder housing 12 and the high pressure discharge manifold 36. A suction valve seat member 38 includes a concave circular annulus 40 in fluid tight communication with the inlet line 4, and passageways 42 through the suction valve seat member provide fluid communication to the pump chamber 14. Suction valve seat member 38 provides the desired in-line pump design, and annulus 40 thus serves as a fluid inlet to the pump chamber. An inlet valve assembly 44 reciprocates along an axis substantially coincident with axis 18 to allow fluid to enter the expanding pump chamber 14 during the intake stroke of the piston 16, and prevents fluid from passing back to annulus 40 during the discharge stroke of the pump. During the pump discharge stroke, high pressure fluid thus passes through the inlet valve assembly 44 and through passageway 46 provided in the suction valve seat member 38, then past the pump discharge valve assembly 48 to pump discharge flow line 52 in discharge housing 36. Discharge valve assembly 48 thus prevents high pressure fluid in the flow line 52 from passing back through the suction valve seat member 38 to the pump chamber 14. The passageway 46 in the suction valve seat member 38 also serves as a guide for limiting movement of each of the inlet valve 44 and discharge valve 48 along an axis substantially coincident with the axis 18 of the pump piston 16.

Referring still to FIG. 2, it should be understood that the inlet or suction manifold 34 provides a desired pump rigidity that facilitates fluid communication between the pump inlet line and the chamber 40, but need not provide a high pressure sealing function. Seals 54 thus provide a low pressure seal between the suction valve member 38 and manifold 34. Static seals 56, however, provide a high pressure seal between the pump housing 12 and the suction valve seat member 38, and it is thus seal 56 that must reliably withstand the high pressures generated within the pump chamber 14 during the compression stroke. Static seal 58, which acts between the pump discharge housing 36 and the suction valve seat member 38, similarly must withstand the high pressures generated during the compression stroke of the pump, although the diameter of seal 58 according to the in-line pump design as shown in FIG. 2 is less than the diameter of the seal 56. Accordingly, seal 56 is the seal that is likely to rupture if a sufficient compressive force is not maintained to keep suction valve seat member 38 compressed between the pump discharge housing 36 and the pump housing 12.

Those skilled in the art will appreciate that the forces necessary to accomplish this purpose are provided by a plurality of compression members, which typically are rods 60. Each of the rods 60 thus has a threaded end 62 that is structurally threaded to packing ring housing 26. Each rod passes through drilled holes provided in the housings 34, 36, and 50, and nuts 64 and threads 66 at the opposite end of the rod conventionally may be torqued to provide the desired compressive forces to maintain the sealing function of seal 56.

Before proceeding to discuss how these compressive forces are preferably generated according to the present invention, it should be noted that the suction valve seat member 38 and the pump discharge housing 36 depicted in FIG. 2 form one embodiment for desired in-line pump design according to the present invention, but also create a somewhat unique situation whereby the pump discharge housing is not be maintained in static sealing engagement directly with the pump housing. In other words, many pumps are designed such that the pump piston moves within a pump housing, and the pump discharge housing which has a pump discharge line therein receives fluid directly from the pump chamber which is passed by a discharge check valve. A static seal is then provided for maintaining sealed engagement between the pump housing and the pump discharge housing. For such pumps, it is typically this static seal between the pump housing and the pump discharge housing that would leak if sufficient compressional forces were not applied to maintain this sealing engagement. From the design as shown in FIG. 2, however, the suction valve seat member 38 is sandwiched between the pump housing and the pump discharge housing in order to provide the desired in-line pump design.

It should thus be understood that the concepts of the present invention may be applied to a pump that includes a static seal for sealing engagement directly between the pump housing and the pump discharge housing. In such cases, the pump discharge housing may be considered an outlet housing having a pump discharge flow line therein, and for the situation shown in FIG. 2, the same outlet housing 68 comprises the combination of the suction valve seat member 38 and the pump discharge housing 36. From the standpoint of understanding the compressive forces that must be applied to maintain the pump in reliable operation, the housing 68 comprising members 36 and 38 is thus provided with static seals that must maintain reliable sealing engagement between the outlet housing 68 and the pump housing 12.

The pump according to the present invention includes a pressure housing 70 having a liquid pressure chamber 72 therein. For the pump depicted in FIG. 2, the pressure housing 70 is integral with the discharge housing 36, and preferably is formed as single component with the pump discharge housing 36 from a block of steel. The liquid pressure chamber 72 is in fluid communication with the pump discharge flow line 52 in housing 36, and FIG. 2 depicts this fluid communication being provided by compression line 74. For the depicted embodiment, the compression line 74 comprises flow line 76 external of the housings 36 and 70, and flow path 78 within the pressure housing 70. Operation of a control valve 80 along line 74 for controlling fluid communication between the pump discharge flow line 52 and the liquid pressure chamber 72 is discussed subsequently. It should be understood that control valve 80 preferably includes a valve body 82 having a seat schematically depicted at 84 for sealing engagement with a control valve member 86, and the valve body 82 is structurally separate from the other housing shown in FIG. 2. The sealing member, which preferably is in the form of a pressure-transmitting piston 90, is movable within the pressure housing 70. Dynamic seal 92 provides high pressure sealing between housing 70 and the body 94 of the piston 90, and also transmits force from the liquid pressure chamber 72 to the plate 50 and then to compression members or rods 60 in order to create the desired axial load on each of the compression members to maintain sealing engagement between the outlet housing and the pump housing.

For the FIG. 2 embodiment, high pressure within the chamber 72 thus acts upon the piston 90 to transmit a force to the pressure-receiving plate or housing 50, thus tending to structurally separate the plate 50 from the pressure housing 70. This action thus places an axial load on each of the plurality of force-transmitting rods 60, thereby providing a convenient method of placing the outlet housing and the pump housing in reliable sealing engagement. The force-transmitting piston 90 preferably has a dynamic cross-sectional sealing area that is greater than the cross-sectional sealing area of the static seal 56 between the pump housing 12 and the outlet housing 68, so that as long as the pressure in liquid pressure chamber 72 is equal or even slightly less than the pressure in the discharge flow line 52, the compressive force provided by the piston 90 will be sufficient to provide the forces necessary to maintain static seal 56 in sealing engagement. Preferably, the selected cross-sectional sealing area for the piston 90 is more than about 25% greater than the cross-sectional area of the static seal 56.

Figure 3:
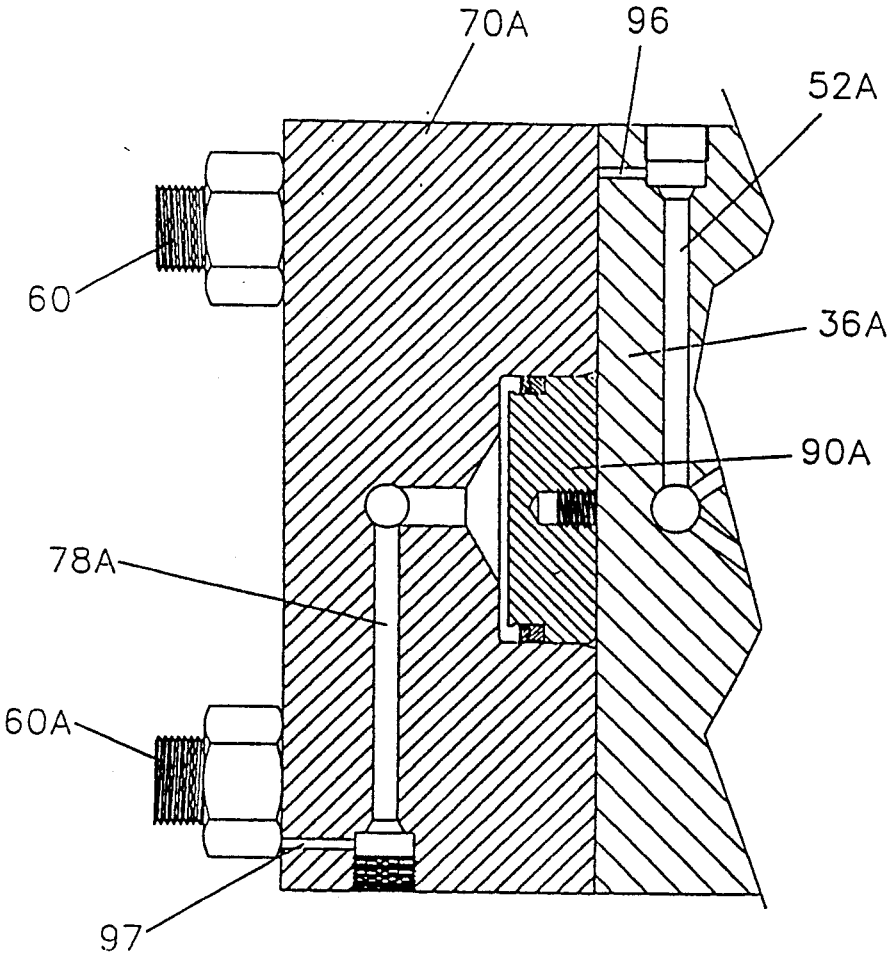
FIG. 3 is a detailed cross-sectional view of a portion of an alternate embodiment of a pump according to the present invention.

FIG. 3 depicts an alternate embodiment of a pump according to the present invention, and more particularly depicts a portion of a pump having a pressure housing 70A that is formed structurally separate from the pump discharge housing. The embodiment of FIG. 3 thus allows pressure housing 70A to be added to an otherwise existing pump having a discharge housing 36A and a pump discharge flow line 52A therein. Piston 90A and flow path 78A provide the function of the components previously described. Piston 90A thus acts directly on the pump discharge or outlet housing 36A to place compression members 60A in tension, and thereby maintain a desired compressive force between the pump housing 12 and the outlet housing 36A. The small diameter in lines 96 and 97 in the housing 36A and housing 70A, respectively, serve to prevent build-up of static pressure between the threads on the plug or fitting which is connected to the housing 36A or 70A.

According to the method of the present invention, a pressure housing with a force-transmitting piston or other sealing member is provided as described above. Prior to energizing the pump, the nuts 64 may be snugly tightened, but only a low torque of, for example, 100 foot pounds need be applied to each of the nuts. The pump is activated to generate a pre-selected high pressure within the pump discharge flow line. Preferably this pressure will be the maximum pressure at which the pump is intended to operate prior to the pump being disassembled for repair or overhaul. While the pump is operating at this desired pressure level, the valve 80 is open to allow the high pressure fluid to pass to the liquid pressure chamber 72 and create the desired load on each of the compression rods. The valve is then closed to seal the high pressure fluid within the liquid pressure chamber, thereby maintaining the desired high load on each of the plurality of compression members. By maintaining a high load on the compression members, the fatigue of the compression members is decreased compared to a situation wherein the compression members would be repeatedly loaded and unloaded. Moreover, the desired high compressive force within each of the compression rods is easily obtained, but none of the compression rods is either under-loaded or over-loaded to accomplish its desired purpose. The safety of the assembly is thus significantly increased by the present invention.

When the pump is deactivated, the high pressure is still maintained with the pressure housing. If there is a pressure loss from the liquid pressure chamber 72, the pump may be activated as described above and the control valve 80 opened then closed to pressurize the liquid pressure chamber at the desired high pressure. A log may be maintained to record the number of times the compression rods 60 are loaded and reloaded, and the rods 60 desirably may be replaced at regular intervals as a function of the number of loading and reloading operations. To repair a pump according to the present invention, the pump is merely deactivated and the valve 80 opened to release pressure from the liquid pressure chamber 72, then the nuts 64 may then be unthreaded with only a slight torque.

To further facilitate safety of a pump according to the present invention, one or more pressure gauges, switches, or strain gauges such as gauge 98 simplistically shown in FIG. 2 may be applied to one or more of the rods 60, with each gauge 98 being used to ensure that the pump is shut off and/or an alarm activated if an axial load above or below a pre-selected limit is applied to the monitored compression rod. Gauge 98 also may automatically provide a signal to a computer (not depicted) to record the number of times the monitored compression rod has been loaded and unloaded.

The overall sign of the pump according to the present invention thus achieves the purpose as set forth above. Those skilled in the art will appreciate that many modifications may be made to the embodiments shown in the figures without departing from the spirit or scope of the invention. The foregoing disclosure and description of the invention are thus illustrative, and changes in both the apparatus of the pump and in the method of constructing and operating a pump as described above may be made with departing from the present invention.

What is claimed is:

1. A high pressure pump, comprising:

a pump housing having a fluid inlet and a fluid outlet, and defining a pump chamber therein;

a pump piston linearly moveable within the pump chamber along a central axis during stroking of the pump;

an inlet valve for passing fluid from a pump inlet to the pump chamber and preventing fluid from passing from the pump chamber to the pump inlet;

a discharge valve for passing fluid from the pump chamber and preventing high pressure fluid from returning to the pump chamber;

an outlet housing having a pump discharge flow line therein for receiving high pressure fluid passed by the discharge valve from the pump chamber;

a plurality of compression members spaced outward of the pump chamber for sealingly mating the pump housing and the outlet housing;

a pressure housing having a liquid pressure chamber therein in fluid communication with the pump discharge flow line via a compression line;

a sealing member movable within the pressure housing for sealing high pressure fluid within the liquid pressure chamber while transmitting force from the liquid pressure chamber to the plurality of compression members to create a desired axial load on each of the plurality of compression members; and a control valve spaced along the compression line, such that the control valve may be opened to receive high pressure fluid within the liquid pressure chamber from the pump chamber, then the control valve closed to trap high pressure fluid within the liquid pressure chamber to maintain the desired axial load upon the plurality of compression members.

2. The pump as defined in claim 1, wherein the sealing member comprises a force-transmitting piston within the pressure housing, the force-transmitting piston being movable along a torque transmitting axis substantially coincident with the central axis of the pump piston.

3. The pump as defined in claim 2, further comprising:

a static seal between the pump housing and the outlet housing, the static seal having a cross-sectional sealing area; and the force-transmitting piston having a dynamic cross-sectional sealing area greater than the cross-sectional sealing area of the static seal between the pump housing and the outlet housing.

4. The pump as defined in claim 1, wherein the outlet housing comprises:

a pump discharge housing having the pump discharge flow line therein; and a suction valve seat member including a plurality of passageways for fluid communication between a pump inlet and the pump chamber.

5. The pump as defined in claim 1, wherein:

the outlet housing is integral with the pressure housing; and a force-receiving housing spaced axially opposite the pump housing with respect to the outlet housing; and the sealing member transmits force to the force-receiving housing.

6. The pump as defined in claim 1, wherein:

the outlet housing is structurally separate from the pressure housing; and the sealing member transmits force to the outlet housing.

7. The pump as defined in claim 6, wherein the pressure housing is spaced axially opposite the pump housing with respect to the outlet housing.

8. The pump as defined in claim 1, further comprising:

first and second guide members for restricting movement of the inlet valve and the discharge valve along an axis substantially coincident with the central axis of the pump piston.

9. The pump as defined in claim 1, further comprising:

a plurality of spaced pump pistons each linearly moveable within a respective pump chamber along a respective one of a corresponding plurality of substantially parallel central axes during stroking of the pump;

the pump discharge flow line within the outlet housing being in fluid communication with each of the plurality of pump chambers when fluid is passed by a respective check valve;

a plurality of compression members are spaced outward of each of the plurality of pump chambers; and the pressure housing having a corresponding plurality of liquid pressure chambers and a corresponding plurality of sealing members therein each in fluid communication with the pump discharge flow line via the compression line.

10. The pump as defined in claim 1, wherein the control valve includes a valve body having a seat therein for sealing engagement with a control valve member, the valve body being structurally separate from the outlet housing.

11. The pump as define in claim 1, wherein the compression members comprise a plurality of elongate rods and a corresponding plurality of mating nuts.

12. A high pressure pump, comprising:

a pump housing defining a pump chamber therein;

a pump piston linearly moveable within the pump chamber along a central axis during stroking of the pump;

a suction valve seat member including a fluid inlet and a plurality of passageways for fluid communication between the fluid inlet and the pump chamber;

an inlet valve for passing fluid from the fluid inlet to the pumping chamber and preventing fluid from passing from the pumping chamber to the fluid inlet;

a discharge valve for passing fluid from the pump chamber and preventing high pressure fluid from returning to the pump chamber;

a pump discharge housing having a pump discharge flow line therein for receiving high pressure fluid passed by the discharge valve from the pump chamber;

a plurality of compression members spaced outward of the pump chamber for sealingly mating the suction valve seat member between the pump housing and the pump discharge housing;

a pressure housing having a liquid pressure chamber therein in fluid communication with the pump discharge flow line via a compression line;

a force-transmitting piston movable within the pressure housing for sealing high pressure fluid within the liquid pressure chamber while transmitting force from the liquid pressure chamber to the plurality of compression members to create a desired axial load on each of the plurality of compression members; and a control valve spaced along the compression line, such that the control valve may be opened to receive high pressure fluid within the liquid pressure chamber from the pump chamber, then the control valve closed to trap high pressure fluid within the liquid pressure chamber to maintain the desired axial load upon the plurality of compression members.

13. The method as defined in claim 12, wherein:

the force-transmitting piston is movable along a torque transmitting axis substantially coincident with the central axis of the pump piston.

14. The pump as defined in claim 12, further comprising:

a static seal between the pump housing and the suction valve seat member, the static seal having a cross-sectional sealing area; and the force-transmitting piston having a dynamic cross-sectional sealing area greater than the cross-sectional sealing area of the static seal between the pump housing and the suction valve seat member.

15. The pump as defined in claim 12, wherein:

the pump discharge housing is integral with the pressure housing; and a force-receiving housing spaced axially opposite the pump housing with respect to the pump discharge housing; and the force-transmitting piston transmits force to the force-receiving housing.

16. The pump as defined in claim 12, wherein:

the pump discharge housing is structurally separate from the pressure housing; and the force-transmitting piston transmits force to the pump discharge housing.

17. The pump as defined in claim 12, further comprising:

the suction valve seat member having an inlet seat for sealing engagement with the inlet valve and an outlet seat for sealing engagement with the discharge valve; and first and second guide means for restricting movement of the inlet valve and the discharge valve along an axis substantially coincident with the central axis of the pump piston.

18. The pump as defined in claim 12, further comprising:

a plurality of spaced pump pistons each linearly moveable within a respective pump chamber along a respective one of a corresponding plurality of substantially parallel central axes during stroking of the pump;

the pump discharge flow line within the pump discharge housing being in fluid communication with each of the plurality of pump chambers when fluid is passed by a respective check valve;

a plurality of compression members are spaced outward of each of the plurality of pump chambers; and the pressure housing having a corresponding plurality of liquid pressure chambers and a corresponding plurality of sealing members therein each in fluid communication with the pump discharge flow line via the compression line.

19. The pump as defined in claim 12, further comprising:

the control valve including a valve body having a seat therein for sealing engagement with a control valve member, the valve body being structurally separate from the pump discharge housing; and the compression members comprising a plurality of elongate rods and a corresponding plurality of mating nuts.

20. Apparatus for subjecting each of a plurality of pump compression members to a load for sealingly mating a pump housing and a pump discharge housing, the pump housing defining a pump chamber therein receiving a pump piston moveable along a central axis during stroking of the pump, and the pump discharge housing having a pump discharge flow line therein for receiving high pressure fluid from the pump chamber, the apparatus comprising:

a pressure housing having a fluid inlet, a fluid outlet, and a liquid pressure chamber therein for fluid communication with the pump discharge flow line via a compression line;

one or more valves for controlling directional flow through the liquid pressure chamber;

a sealing member movable within the pressure housing for sealing high pressure fluid within the liquid pressure chamber while transmitting force from the liquid pressure chamber to the plurality of compression members to create a desired axial load on each of the plurality of compression members; and a control valve spaced along the compression line, such that the control valve may be opened to receive high pressure fluid within the liquid pressure chamber from the pump chamber, then the control valve closed to trap high pressure fluid within the liquid pressure chamber to maintain the desired axial load upon the plurality of compression members.

21. The apparatus as defined in claim 20, wherein the sealing member comprises a force-transmitting piston within the pressure housing, the force-transmitting piston being movable along an axis substantially coincident with the central axis of the pump piston.

22. The apparatus as defined in claim 20, wherein:

the pump discharge housing is structurally separate from the pressure housing;

the pressure housing is spaced opposite the pump housing with respect to the pump discharge housing; and the sealing member transmits force to the pump discharge housing.

23. A method of axially loading a plurality of compression members spaced outward of a pump chamber provided within a pump housing for receiving a pump piston therein movable along a pump central axis, the pump housing being in sealed engagement with an outlet housing having a pump discharge flow line therein for receiving fluid from the pump chamber, the method comprising:

providing a pressure housing having a liquid pressure chamber therein in fluid communication with the pump discharge flow line via a compression line;

providing a sealing member movable within the pressure housing for sealing high pressure fluid within the liquid pressure chamber while transmitting force to the plurality of compression members;

activating the pump piston to generate a desired high pressure within the pump discharge flow line;

opening the compression line while the pump is activated to pass high pressure fluid to the liquid pressure chamber and create a desired load on each of the plurality of compression members; and closing the compression line to seal the high pressure fluid within the liquid pressure chamber while maintaining the high load on each of the plurality of compression members.

24. The method as defined in claim 23, further comprising:

restricting movement of the sealing member in a direction along a force-transmitting axis substantially coincident with the pump central axis.

25. The method as defined in claim 23, further comprising:

selecting a dynamic cross-sectional sealing area for the sealing member that is greater than a cross-sectional sealing area between the pump housing and the outlet housing.

26. The method as defined in claim 23, wherein the selected dynamic cross-sectional sealing area for the sealing member is at least 25% greater than the cross-sectional sealing area between the pump housing and the outlet housing.

27. The method as defined in claim 23, further comprising:

structurally affixing the pressure housing to the outlet housing; and providing a pressure-receiving housing structurally separate from the pressure housing for receiving the force from the sealing member and thereby placing the desired load on each of the compression members.

28. The method as defined in claim 23, further comprising:

forming the pressure housing structurally separate from the outlet housing;

positioning the pressure housing axially opposite the pump housing with respect to the outlet housing; and the sealing member transmits force to the outlet housing and thereby transmits the desired load on each of the compression members.

29. The method as defined in claim 23, further comprising:

restricting movement of a suction valve to the pump chamber and a discharge valve from the pump chamber, such that each of the suction valve and discharge valve is movable along an axis substantially coincident with the central axis of the pump piston.

* * * * *